US008766553B2

(12) United States Patent
Lin et al.

(10) Patent No.: US 8,766,553 B2
(45) Date of Patent: Jul. 1, 2014

(54) SERIAL-TYPE LIGHT-EMITTING DIODE (LED) DEVICE

(71) Applicant: Top Victory Investments Ltd., Kowloon (TW)

(72) Inventors: Li-Wei Lin, New Taipei (TW); Chen-Chiang Lee, New Taipei (TW); Chi-Hsin Lee, New Taipei (TW)

(73) Assignee: Top Victory Investments Ltd., Kowloon (HK)

( * ) Notice: Subject to any disclaimer, the term of this patent is extended or adjusted under 35 U.S.C. 154(b) by 0 days.

(21) Appl. No.: 13/913,737

(22) Filed: Jun. 10, 2013

(65) Prior Publication Data

US 2013/0264955 A1 Oct. 10, 2013

Related U.S. Application Data

(62) Division of application No. 12/974,074, filed on Dec. 21, 2010.

(30) Foreign Application Priority Data

Dec. 21, 2009 (TW) ..... 98143826 A
Apr. 8, 2010 (TW) ..... 99206202 U

(51) Int. Cl.
*G05F 1/00* (2006.01)

(52) U.S. Cl.
USPC ..... 315/291; 315/247; 315/274; 315/185 S; 315/312

(58) Field of Classification Search
USPC ..... 315/274–288, 185 S, 291, 247, 312, 315/307, DIG. 4
See application file for complete search history.

(56) References Cited

U.S. PATENT DOCUMENTS

| | | | |
|---|---|---|---|
| 4,293,799 | A | 10/1981 | Roberts |
| 6,229,720 | B1 | 5/2001 | Noma et al. |
| 7,517,989 | B2 | 4/2009 | Luckhurst et al. |
| 7,728,529 | B2 | 6/2010 | Liu et al. |
| 7,768,212 | B2 | 8/2010 | Chen et al. |
| 7,977,891 | B2 | 7/2011 | Shiu et al. |
| 8,344,656 | B2 | 1/2013 | Du et al. |
| 8,390,262 | B2 | 3/2013 | Chang et al. |

(Continued)

FOREIGN PATENT DOCUMENTS

| | | | |
|---|---|---|---|
| TW | 200915262 | A | 4/2009 |
| TW | 200938007 | A | 9/2009 |

*Primary Examiner* — Tuyet Thi Vo
(74) *Attorney, Agent, or Firm* — Alan Kamrath; Kamrath IP Lawfirm, P.A.

(57) ABSTRACT

A serial-type LED device includes p light source units and a dimming circuit. Each light source unit includes first and second terminals, m light strings and m current balance units. Each light string includes LEDs coupled in series to have a first terminal coupled to the first terminal of a corresponding light source unit and a second terminal coupled to the second terminal of the corresponding light source unit through a corresponding current balance unit. The first terminal of the first light source unit is coupled to a second DC voltage, and the second terminal of the i-th light source unit is coupled to the first terminal of the (i+1)-th light source unit, where m and p are integers greater than or equal to 2 and i is any integer from 1 to (p−1). The dimming circuit coupled to the second terminal of the p-th light source unit controls the second DC voltage according to a current outputted from the p-th light source unit.

4 Claims, 2 Drawing Sheets

(56) References Cited

U.S. PATENT DOCUMENTS 8,410,711 B2 4/2013 Lin et al.
8,552,654 B2 * 10/2013 Lenk ..... 315/185 S
2008/0074058 A1 3/2008 Lee et al.
2010/0301762 A1 12/2010 Kung et al.
2012/0306387 A1 12/2012 Ferguson

* cited by examiner

SERIAL-TYPE LIGHT-EMITTING DIODE (LED) DEVICE

CROSS-REFERENCE TO RELATED APPLICATIONS

The present application is a division of U.S. patent application Ser. No. 12/974,074 filed Dec. 21, 2010, now U.S. Pat. No. 8,610,368, which claims the priority benefit of Taiwan patent application serial no. 98143826, filed Dec. 21, 2009, and Taiwan patent application serial no. 99206202, filed Apr. 8, 2010, the contents of which are hereby incorporated by reference herein in their entireties.

BACKGROUND OF THE INVENTION

1. Field of the Invention

The present invention relates to a light-emitting diode (LED) device. More particularly, the present invention relates to a serial-type LED device.

2. Description of the Related Art

An LED light source employs a plurality of LEDs to provide sufficient brightness. The LEDs can be coupled in series to drive so that each LED provides substantially the same brightness due to the same current flowing through each LED. However, the serial LEDs will not work if one of the LEDs does not work. In addition, the driving voltage applied to the serial LEDs increases as the number of the LEDs coupled in series increases, so that the driving voltage may be too high, resulting in higher cost and increasing complexity of the circuit design.

To avoid the disadvantage of the serial LEDs, the LEDs can be divided into several groups. The LEDs of each group are coupled in series as a light string, and all light strings are coupled in parallel, so that the LEDs of each light string provide substantially the same brightness and so that each light string provides the same brightness by employing a current balance technology. In addition, if one of the light strings does not work, the others of the light strings can still work. However, as the number of the light strings increases, the circuit design of the current balance circuit becomes complex.

SUMMARY OF THE INVENTION

Accordingly, a serial-type LED device is provided for employing a simple current balance circuit while avoiding that all light strings will not work if one of the light strings does not work.

According to an aspect of the invention, a serial-type LED device includes a direct-current to direct-current (DC to DC) converter, p light source units and a dimming circuit. The DC to DC converter receives a first DC voltage and converts the first DC voltage to a second DC voltage according to a feedback signal. Each light source unit includes a first terminal, a second terminal, m light strings and m current balance units, and each light string includes a plurality of LEDs coupled in series to have a first terminal coupled to the first terminal of a corresponding light source unit and a second terminal coupled to the second terminal of the corresponding light source unit through a corresponding current balance unit. The p light source units are first to p-th light source units, the first terminal of the first light source unit is coupled to the DC to DC converter to receive the second DC voltage, and the second terminal of the i-th light source unit is coupled to the first terminal of the (i+1)-th light source unit, where m and p are integers greater than or equal to 2 and i is any integer from 1 to (p−1). The dimming circuit coupled to the second terminal of the p-th light source unit and the DC to DC converter outputs the feedback signal according to a dimming signal and a current outputted from the p-th light source unit.

In another embodiment, the m light strings of the q-th light source unit constitute a q-th light bar, where q is any integer from 1 to p. The first to p-th light bars are arranged to be a backlight of a display device.

In another embodiment, each current balance unit of the q-th light source unit includes a transistor, where q is any integer from 1 to p. Each transistor includes a first terminal coupled to the second terminal of a corresponding light string, a second terminal coupled to the second terminal of the q-th light source unit, and a control terminal. The control terminals of the transistors are coupled to each other and to the first terminal of one of the transistors, so that the transistors of the q-th light source unit constitute a q-th current mirror.

In another embodiment, the dimming circuit includes a first switch including a first terminal coupled to the second terminal of the p-th light source unit, a second terminal coupled to the DC to DC converter, and a control terminal coupled to receive the dimming signal having a pulse-width modulation (PWM) waveform. The first switch is turned on or off according to the dimming signal.

In another embodiment, the dimming circuit further includes a second switch including a first terminal coupled to the control terminal of the first switch, a second terminal coupled to a disable signal, and a control terminal coupled to receive an on-off signal. The second switch is turned on or off according to the on-off signal. When the second switch is turned on, the disable signal is coupled to the control terminal of the first switch through the second switch, so that the first switch is turned off, and when the second switch is turned off, the disable signal is not coupled to the control terminal of the first switch.

BRIEF DESCRIPTION OF THE DRAWINGS

The foregoing and other features of the disclosure will be apparent and easily understood from a further reading of the specification, claims and by reference to the accompanying drawings in which:

DESCRIPTION OF THE PREFERRED EMBODIMENTS

Figure 1:
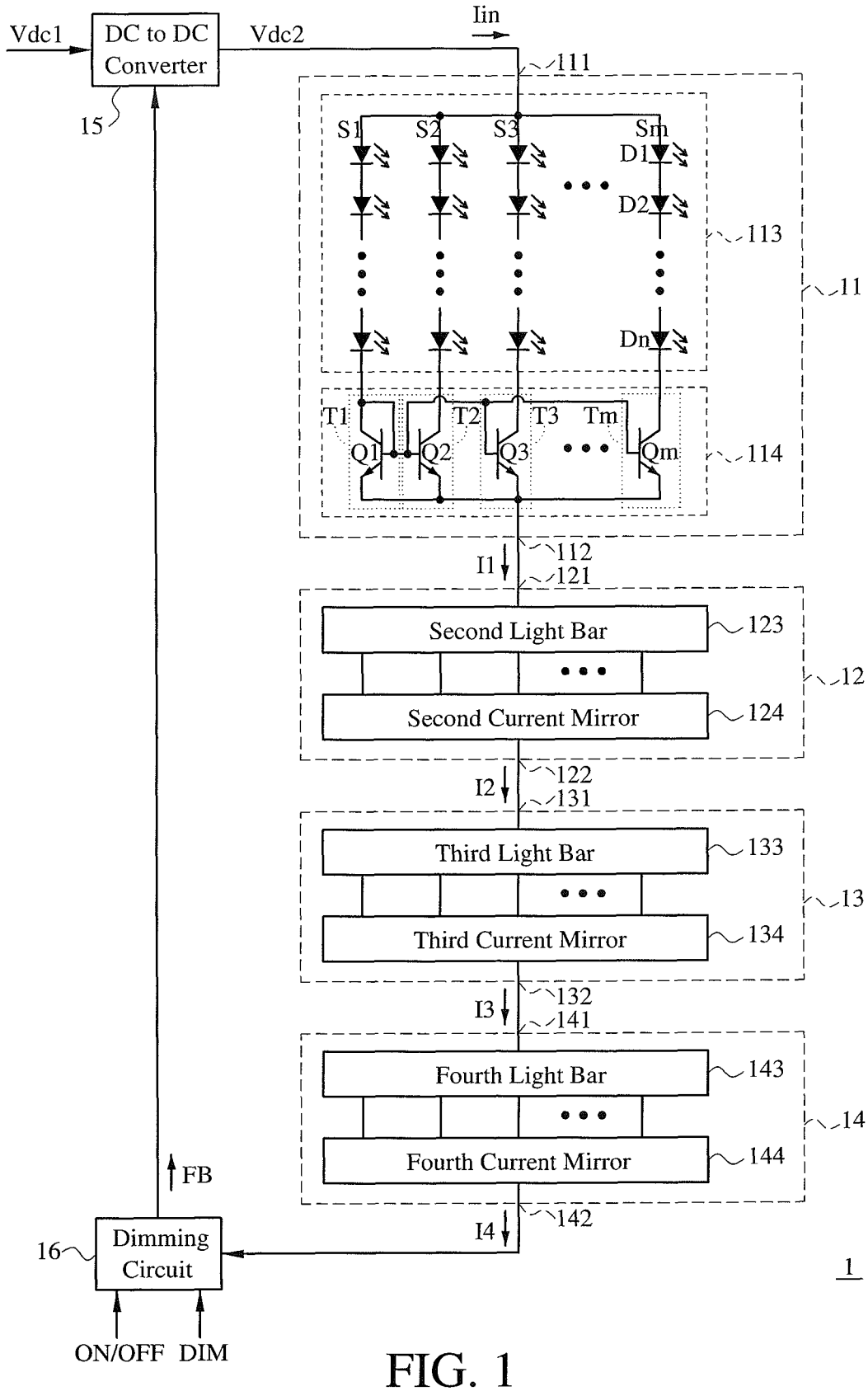
FIG. 1 is a schematic diagram illustrating an embodiment of a serial-type LED device according to the invention.

FIG. 1 is a schematic diagram illustrating an embodiment of a serial-type LED device according to the invention. Referring to FIG. 1, a serial-type LED device 1 includes p light source units, a DC to DC converter 15 and a dimming circuit 16, where p is an integer greater than or equal to 2.In the embodiment, p is 4, and the serial-type LED device 1 includes 4 light source units 11-14. The DC to DC converter 15 receives a first DC voltage Vdc1 and converts the first DC voltage Vdc1 to a second DC voltage Vdc2 according to a feedback signal FB. The DC to DC converter 15 employs a full-bridge, half-bridge, forward, flyback or other suitable topology. The first DC voltage Vdc1 is 5V, 12V, 24V or other typical voltage provided by a power supply (not shown). The second DC voltage Vdc2 is sufficient to drive the light source units 11-14.

Each light source unit includes a first terminal, a second terminal, m light strings and m current balance units, where m is an integer greater than or equal to 2. For example, the light source unit 11 includes the first terminal 111, the second terminal 112, the light strings S1-Sm and the current balance units T1-Tm. Each light string includes a plurality of LEDs coupled in series to have a first terminal coupled to the first terminal of a corresponding light source unit and a second terminal coupled to the second terminal of the corresponding light source unit through a corresponding current balance unit. For example, in the light source unit 11, each light string, such as light string S1, includes the LEDs D1-Dn coupled in series to have the first and second terminals. The first terminal of the light string S1 is coupled to the first terminal 111 of a corresponding light source unit 11, and the second terminal of the light string Si is coupled to the second terminal 112 of the corresponding light source unit 11 through a corresponding current balance unit T1. Therefore, the light strings S1-Sm are substantially coupled in parallel and controlled to achieve current balance through the current balance units T1-Tm.

The light source units 11-14 are the first light source unit 11, the second light source unit 12, the third light source unit 13 and the fourth light source unit 14. The first terminal 111 of the first light source unit 11 is coupled to the DC to DC converter 15 to receive the second DC voltage Vdc2, the second terminal 112 of the first light source unit 11 is coupled to the first terminal 121 of the second light source unit 12, the second terminal 122 of the second light source unit 12 is coupled to the first terminal 131 of the third light source unit 13, the second terminal 132 of the third light source unit 13 is coupled to the first terminal 141 of the fourth light source unit 14, and the second terminal 142 of the fourth light source unit 14 is coupled to the dimming circuit 16. Therefore, the light source units 11-14 are substantially coupled in series to employ a simple dimming circuit such as the dimming circuit 16. In addition, an input current Iin is equal to a current I1, I2, I3 or I4 outputted from the light source unit 11, 12, 13 or 14.

The dimming circuit 16 is coupled to the second terminal 142 of the fourth light source unit 14 and to the DC to DC converter 15. The dimming circuit 16 outputs the feedback signal FB according to the current 14 outputted from the fourth light source unit 14, and the feedback signal FB, such as a current proportional to the current 14, is used to control the DC to DC converter 15 to modulate the second DC voltage Vdc2. The dimming circuit 16 can control the second terminal 142 of the light source unit 14 to be open or coupled to ground according a dimming signal DIM having a PWM waveform (alternately at a high level and a low level). The current balance units T1-Tm are worked so that the light source units 11-14 are turned on to provide light while the second terminal 142 of the second light source unit 14 is coupled to ground, and the light source units 11-14 are turned off to provide no light while the second terminal 142 of the second light source unit 14 is open, so that it achieves a PWM dimming. In other words, the current balance units T1-Tm are alternately worked and not worked according to the PWM dimming.

In one embodiment, the light strings S1-Sm of the q-th light source unit constitute a q-th light bar, where q is any integer from 1 to p. For example, in the embodiment, p is 4. The light strings S1-Sm of the first light source unit 11 constitute the first light bar 113, the light strings S1-Sm of the second light source unit 12 constitute the second light bar 123, the light strings S1-Sm of the third light source unit 13 constitute the third light bar 133, and the light strings S1-Sm of the fourth light source unit 14 constitute the fourth light bar 143. The first to fourth light bars can be arranged to be a backlight of a display device. For example, the first and second light bars 113 and 123 are arranged on the upper side of the display panel of the display device, and the third and fourth light bars 133 and 143 are arranged on the lower side of the display panel of the display device.

In one embodiment, each current balance unit of the q-th light source unit includes a transistor, such as, but not limited to, an NPN bipolar junction transistor (BJT) or N-channel field-effect transistor (FET), where q is any integer from 1 to p. Each transistor comprises a first terminal coupled to the second terminal of a corresponding light string, a second terminal coupled to the second terminal of the q-th light source unit, and a control terminal. The control terminals of the transistors are coupled to each other and the first terminal of one of the transistors so that the transistors of the q-th light source unit constitute a q-th current mirror. For example, in the embodiment, p is 4, and the current balance units T1-Tm of the first light source unit 11 are matched transistors Q1-Qm, such as NPN BJTs, with each including a first terminal (i.e. a collector terminal), a second terminal (i.e. an emitter terminal) and a control terminal (i.e. a base terminal). The first terminal of the transistor Q1 is coupled to the second terminal of a corresponding light string S1, the first terminal of the transistor Q2 is coupled to the second terminal of a corresponding light string S2, . . . , and the first terminal of the transistor Qm is coupled to the second terminal of a corresponding light string Sm. The second terminals of the transistors Q1-Qm are coupled to the second terminal 112 of the first light source unit 11. The control terminals of the transistors Q1-Qm are coupled to each other and to the first terminal of one of the transistors Q1-Qm, such as the first terminal of the transistor Q1. Accordingly, the transistors Q1-Qm of the first light source unit 11 constitute the first current mirror 114. In addition, the transistors Q1-Qm of the second light source unit 12 constitute the second current mirror 124, the transistors Q1-Qm of the third light source unit 13 constitute the third current mirror 134, and the transistors Q1-Qm of the fourth light source unit 14 constitute the fourth current mirror 144. The current mirrors 114, 124, 134 and 144 cause the light bars 113, 123, 133 and 143 to achieve current balance, respectively.

Figure 2:
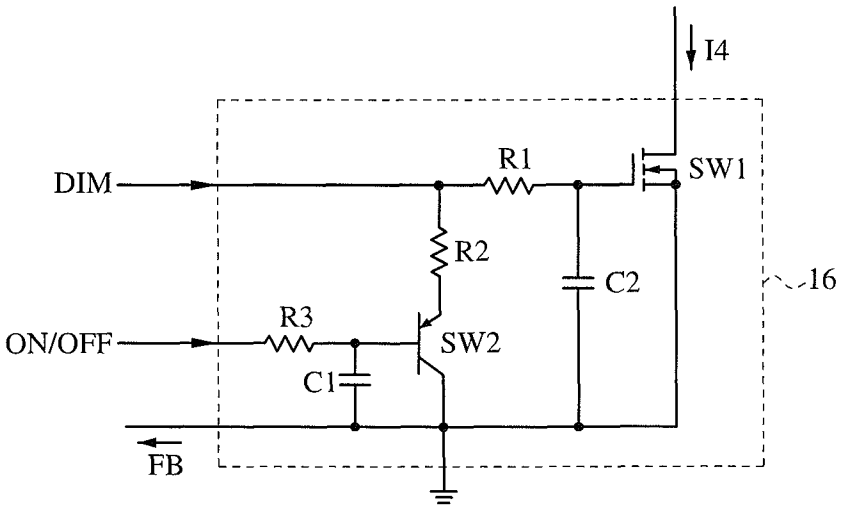
FIG. 2 is a schematic diagram illustrating an embodiment of the dimming circuit shown in FIG. 1.

FIG. 2 is a schematic diagram illustrating an embodiment of the dimming circuit 16 shown in FIG. 1. Referring to FIG. 2, the dimming circuit 16 includes a first switch SW1 and a second switch SW2, and each of the first switch SW1 and the second switch SW2 includes a first terminal, a second terminal and a control terminal. The first terminal of the first switch SW1 is coupled to the second terminal 142 of the fourth light source unit 14 to receive the current 14. The second terminal of the first switch SW1 is coupled to the DC to DC converter 15 to output the feedback signal FB according to the dimming signal DIM and the current 14. The control terminal of the first switch SW1 is coupled to receive the dimming signal DIM. The first switch SW1 is turned on or off according to the dimming signal DIM. The first terminal of the second switch SW2 is coupled to the control terminal of the first switch SW1. The second terminal of the second switch SW2 is coupled to a disable signal. In the embodiment, the disable signal is a low-level signal such as a ground signal. The control terminal of the second switch SW2 is coupled to receive an on-off signal ON/OFF. The second switch SW2 is turned on or off according to the on-off signal ON/OFF.

When the second switch SW2 is turned on, the disable signal is coupled to the control terminal of the first switch SW1 through the second switch SW2 so that the first switch SW1 is turned off When the second switch SW2 is turned off, the disable signal cannot be coupled to the control terminal of the first switch SW1, and the control terminal of the first switch SW1 will receive the dimming signal DIM so that the first switch SW1 is turned on or off according to the dimming signal DIM. In the embodiment, the first switch SW1 is implemented by an N-channel FET, and the second switch SW2 is implemented by a PNP BJT. The resistors R1-R3 are used to limit currents flowing through the switches SW1 and SW2 implemented by transistors. The capacitors C1 and C2 are used to filter high-frequency noise.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

We claim:

1. A serial-type light-emitting diode (LED) device comprising:

a direct-current to direct-current (DC to DC) converter for receiving a first DC voltage and converting the first DC voltage to a second DC voltage according to a feedback signal;

p light source units each comprising a first terminal, a second terminal, m light strings and m current balance units, with each light string comprising a plurality of LEDs coupled in series to have a first terminal coupled to the first terminal of a corresponding light source unit and a second terminal coupled to the second terminal of the corresponding light source unit through a corresponding current balance unit, wherein the p light source units are first to p-th light source units, wherein the first terminal of the first light source unit is coupled to the DC to DC converter to receive the second DC voltage, and wherein the second terminal of the i-th light source unit is coupled to the first terminal of the (i+1)-th light source unit, where m and p are integers greater than or equal to 2 and i is any integer from 1 to (p−1); and a dimming circuit coupled to the second terminal of the p-th light source unit and the DC to DC converter for outputting the feedback signal according to a dimming signal and a current outputted from the p-th light source unit, wherein each current balance unit of the q-th light source unit comprises a transistor, where q is any integer from 1 to p, wherein each transistor comprises a first terminal coupled to the second terminal of a corresponding light string; a second terminal coupled to the second terminal of the q-th light source unit; and a control terminal, and wherein the control terminals of the transistors are coupled to each other and to the first terminal of one of the transistors, with the transistors of the q-th light source unit constituting a q-th current mirror.

2. The serial-type LED device according to claim 1, wherein the m light strings of the q-th light source unit constitute a q-th light bar, where q is any integer from 1 to p, and wherein the first to p-th light bars are arranged to be a backlight of a display device.

3. A serial-type light-emitting diode (LED) device comprising:

a direct-current to direct-current (DC to DC) converter for receiving a first DC voltage and converting the first DC voltage to a second DC voltage according to a feedback signal;

p light source units each comprising a first terminal, a second terminal, m light strings and m current balance units, with each light string comprising a plurality of LEDs coupled in series to have a first terminal coupled to the first terminal of a corresponding light source unit and a second terminal coupled to the second terminal of the corresponding light source unit through a corresponding current balance unit, wherein the p light source units are first to p-th light source units, wherein the first terminal of the first light source unit is coupled to the DC to DC converter to receive the second DC voltage, and wherein the second terminal of the i-th light source unit is coupled to the first terminal of the (i+1)-th light source unit, where m and p are integers greater than or equal to 2 and i is any integer from 1 to (p−1); and a dimming circuit coupled to the second terminal of the p-th light source unit and the DC to DC converter for outputting the feedback signal according to a dimming signal and a current outputted from the p-th light source unit, wherein the dimming circuit comprises a first switch comprising a first terminal coupled to the second terminal of the p-th light source unit; a second terminal coupled to the DC to DC converter; and a control terminal coupled to receive the dimming signal having a pulse-width modulation (PWM) waveform, and wherein the first switch is turned on or off according to the dimming signal.

4. The serial-type LED device according to claim 3, wherein the dimming circuit further comprises a second switch comprising a first terminal coupled to the control terminal of the first switch; a second terminal coupled to a disable signal; and a control terminal coupled to receive an on-off signal, wherein the second switch is turned on or off according to the on-off signal, wherein when the second switch is turned on, the disable signal is coupled to the control terminal of the first switch through the second switch, with the first switch turned off, and wherein when the second switch is turned off, the disable signal is not coupled to the control terminal of the first switch.

* * * * *